United States Patent [19]

Fukuda et al.

[11] 4,359,512

[45] Nov. 16, 1982

[54] LAYERED PHOTOCONDUCTIVE MEMBER HAVING BARRIER OF SILICON AND HALOGEN

[75] Inventors: Tadaji Fukuda, Kawasaki; Shigeru Shirai, Yamato; Junichiro Kanbe, Yokohama, all of Japan

[73] Assignee: Canon Kabushiki Kaisha, Tokyo, Japan

[21] Appl. No.: 240,838

[22] Filed: Mar. 5, 1981

[30] Foreign Application Priority Data

Jun. 9, 1980 [JP] Japan ..... 55/78059

[51] Int. Cl.[3] ..... G03G 5/09; G03G 5/082

[52] U.S. Cl. ..... 430/57; 430/58; 430/65; 430/130; 430/132; 430/900; 427/93; 427/95

[58] Field of Search ..... 430/57, 58, 65, 130, 430/132

[56] References Cited

U.S. PATENT DOCUMENTS

| | | | |
|---|---|---|---|
| 4,217,374 | 8/1980 | Ovshinsky | 427/39 |
| 4,226,898 | 10/1980 | Ovshinsky et al. | 427/39 |
| 4,255,222 | 9/1980 | Kempter | 355/3 DR |
| 4,265,991 | 5/1981 | Hirai et al. | 430/64 |

*Primary Examiner*—John D. Welsh

*Attorney, Agent, or Firm*—Fitzpatrick, Cella, Harper & Scinto

[57] ABSTRACT

Disclosed is a panchromatic photoconductive element for electrophotography having a layered structure comprising a substrate, a barrier layer and a photoconductive layer. The barrier layer inhibits injection of carriers from the substrate. Amorphous silicon forms a matrix for either the photoconductive layer or the barrier layer.

36 Claims, 4 Drawing Figures

LAYERED PHOTOCONDUCTIVE MEMBER HAVING BARRIER OF SILICON AND HALOGEN

This application contains subject matter related to copending application Ser. No. 240,836, filed Mar. 5, 1981.

BACKGROUND OF THE INVENTION

1. Field of the Invention

This invention relates to a photoconductive member which is sensitive to electromagnetic waves such as light (in the broad sense of the term, this includes ultraviolet rays, visible light rays, infrared rays, X-rays, γ-rays, and so forth).

2. Description of the Prior Arts

To constitute a photoconductive layer for an electrophotographic image forming member, image original reading device, and so on, used in a television image pick-up tube, solid-state image pick-up device, etc., or in the field of the image forming technique in general, a photoconductive member is required to have various characteristics such as high sensitivity, high S/N ratio (photo-current ($I_p$)/dark current ($I_d$)), a spectral characteristic specific to an electromagnetic wave, with which it is irradiated, harmlessness to human body when it is used, and in the case of the image pick-up device, capability of readily eliminating a residual image within a set period of time, and so forth. Particularly, in the case of the electrophotographic image forming member to be incorporated in an electrophotographic apparatus used as an office machine, this harmlessness to the human body on its use is of utmost importance.

From such standpoint, amorphous silicon (hereinafter abbreviated as "a-Si") has drawn attention of all concerned in the field of the photoconductive material. At the initial stage of its development, this a-Si film exhibited varying electrical and optical characteristics, because its structure is governed by method and conditions for its manufacture (vide, for example, Journal of Electrochemical Society, Vol. 116, No. 1, pp. 77–81, January 1969), hence a serious problem in its reproducibility. In more detail, at the outset of its development, the a-Si film formed by the vacuum evaporation method and the sputtering method had a great deal of defects such as voids, etc., on account of which the electrical and optical properties of the film were seriously influenced. Moreover, not much attention was paid to it as a material for studying the basic physical properties, nor was there conducted research and development for its applications. However, at the beginning of the year 1976, a report was made for the first time as to possibility of forming a p-n junction in the a-Si, control of the p- and n-type conductivity of which had therefore been considered impossible (vide: Applied Physics Letter, Vol. 28, No. 2, pp. 105–107, Jan. 15, 1976). Since then, attentions have been drawn on this material, and strenuous efforts have been extracted in research and development for its application to the solar battery, mainly. As a result of this, a patent has been granted in the United States (i.e., U.S. Pat. No. 4,064,521) for an invention concerning the photoconductive member for the solar battery.

However, since the a-Si film which has so far been reported and the a-Si film of a layer structure as taught in the above-described U.S. patent have been developed for use in the solar battery, they cannot be effectively used as the photoconductive layer for solid-state image pick-up devices, image original reading devices, electrophotographic image forming members, etc. in view of their electrical and optical characteristics.

In other words, according to various experiments done by the present inventors, it has so far been discovered that, while the a-Si film has a number of advantages as the photoconductive layer forming material for the electrophotographic image forming member in comparison with those conventional photoconductive materials such as inorganic photoconductive materials like Se, CdS, ZnO, or organic photoconductive materials (OPC) like poly-N-vinyl carbazole (PVCz) and trinitrofluorenone (TNF), it still has many problems to be solved before a single-layered electrophotographic image forming member formed of the a-Si material which has been developed for the purpose of the solar battery can be employed. An a-Si film is remarkably fast in its dark decay, even when this a-Si layer is subjected to the charging treatment for the electrostatic image formation, hence the ordinary electrophotographic method is difficult to employ, and that this tendency toward dark decay is considerable in a highly humid atmosphere, and, depending on the case, the layer is utterly incapable of holding the electric charge.

Apart from the abovementioned electrophotographic image forming member using the a-Si, there has recently been proposed a new type of electrophotographic image forming member, the photo-conductive layer of which is made of hydrogenated armophous silicon (hereinafter abbreviated as "a-Si:H") as disclosed in, for example, DOLS No. 2746967 and DOLS No. 2855718.

The electrophotographic image forming member having the photoconductive layer made of such a-Si:H has a number of excellent properties in comparison with the aforementioned electrophotographic image forming member. In other words, the photoconductive layer of either polarity, i.e., p-type or n-type, can be fabricated depending on the manufacturing conditions; the image forming member is perfectly free from liability to environmental pollution; it is excellent in its abrasion-resistant property due to its high surface hardness; it is also excellent in its developer-resistant property; and it is further excellent in its other electrophotographic properties such as cleaning property, moisture-resistant property, and so on.

Even with the a-Si:H type electrophotographic image forming member excellent in its electrophotographic characteristics in various points as mentioned above, there still exist rooms for improvement in respect of its photosensitivity in a practical light quantity region, its γ value, its dark resistivity, its heat-resistant property in a much higher temperature region than a temperature region for ordinary use when conducting a process for improving the characteristics thereof or adding other functions thereto, and its photo response property, etc.

The present invention has been made in view of the afore-described various points of problem, and is based on the finding, as the result of continued strenuous efforts in researches and studies from very general standpoints of adaptability and applicability of the a-Si as the photoconductive member for use in the electrophotographic image forming member, the image pick-up device, image original reading device, etc., that, when two layers having mutually different electrical characteristics, at least one of which comprises an amorphous material with silicon as a matrix and halogen atom (hereinafter abbreviated as "X") as a constituent atom, i.e., halogenated amorphous silicon (hereinafter abbreviated as "a-Si:X"), are laminated in a particular relationship, the photoconductive member to be obtained is not only useful practically, but also excels the conventional photoconductive materials in almost all aspects, in particular, its remarkably superior characteristics as the photoconductive member for the electrophotography.

SUMMARY OF THE INVENTION

It is the principal object of the present invention to provide a photoconductive member which is stable in its electrical and optical characteristics, is adaptable to all circumstances without its uses being almost restricted by the surroundings is remarkably superior in its sensitivity and anti-light-fatigue property, and does not bring about deterioration on its repeated use.

It is another object of the present invention to provide a photoconductive member having a high sensitivity to light, covering substantially entire visible light region in its spectral sensitivity region, and being fast in its photo-response.

It is still another object of the present invention to provide a photoconductive member having sufficient charge-bearing capability, on its charging treatment for the electrostatic image formation, to such an extent that the ordinary electrophotographic method can be adopted extremely effectively when it is used as the electrophotographic image forming member, and having an excellent electrophotographic characteristics which do not substantially deteriorate even in a highly humid atmosphere.

It is other object of the present invention to provide a photoconductive member for the electrophotography capable of producing high quality image having high density, clear half tone, and high resolution.

It is yet other object of the present invention to provide a photoconductive member for electrophotography with further improvement in the photosensitivity in a practical light quantity region, a $\gamma$ value, and a dark resistivity.

It is further object of the present invention to provide a photoconductive member having excellent photoresponse property and heat-resistant property which enables the process for improving the characteristics thereof or adding other functions thereto to be performed stably even at a high temperature.

According to the present invention, generally speaking, there is provided a photoconductive member comprising a substrate for the photoconductive member, a photoconductive layer, and a barrier layer being arranged between the substrate and the photoconductive layer, said barrier layer having a function which inhibits injection of carriers from the side of said substrate into said photoconductive layer, characterized in that at least one of said photoconductive layer and said barrier layer is made of an amorphous material in which silicon atom is a matrix and halogen atom is a constituent atom, a depletion layer region is created at the interfacial region between the photoconductive layer and the barrier layer, a part of said barrier layer is present between said depletion layer region and said substrate in a thickness capable of bringing substantially negligible probability which the carriers having the same polarity as that of the minor carriers in said barrier layer reaches said depletion layer region from the side of said substrate in order to inhibit injection of the carriers having the same polarity as that of the minor carriers in said barrier layer from the side of said substrate to said photoconductive layer, and the photocarriers having the same polarity as that of the major carriers in said barrier layer among photocarriers generating in said photoconductive layer by irradiation of an electromagnetic waves are moved in the direction of said barrier layer.

DESCRIPTION OF PREFERRED EMBODIMENTS

Figure 1:
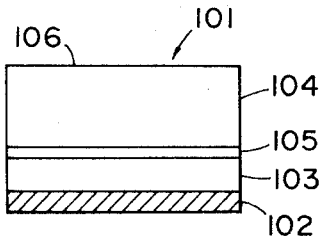
FIGS. 1 and 2 are schematic cross-sectional diagrams showing preferred embodiments of the electrophotographic image forming members according to the present invention.

In order to effectively attain the purpose of the prevent invention, the photoconductive member is so constructed that the barrier layer and the photoconductive layer are laminated onto a substrate for the photo-conductive member in a specified layer relationship to be described in detail hereinbelow, and that each of the layers is selected in a favorable combination meeting the purpose of the present invention from various types of a-Si:X having the semiconductive characteristics as shown below.

(1) $p^-$-type a-Si:X . . . containing acceptor alone at a low concentration, or both donor and accpetor with the acceptor concentration (Na) being slightly higher than the donor concentration;

(2) $p^+$-type a-Si:X . . . containing the acceptor alone at a concentration higher than that of the type (1), or both donor and acceptor with the acceptor concentration (Na) being higher than the donor concentration (Nd), and the donor concentration per se being considerably high;

(3) $n^-$-type a-Si:X . . . containing the donor alone at a low concentration, or both donor and acceptor with the donor concentration (Nd) being slightly higher than the acceptor concentration (Na);

(4) $n^+$-type a-Si:X . . . containing the donor alone at a concentration higher than that of the type (3), or both donor and acceptor with the donor concentration (Nd) being higher than the acceptor concentration (Na), and the donor concentration (Nd) per se being considerably high; and (5) i-type a-Si:X . . . having a relationship of $Na \Omega Nd \simeq O$ or $Na \approx Nd$.

Table 1 below shows favorable combinations of the a-Si:X for constituting both photoconductive layer and barrier layer meeting the purpose of the present invention.

TABLE 1

| Layer | Type A | B | C | D | E | F |
|---|---|---|---|---|---|---|
| Photoconductive Layer | (3) | (1) | (5) | (3) | (1) | (5) |
| Barrier Layer | (2) | (2) | (2) | (4) | (4) | (4) |

The photoconductive member having such layer structure as shown above is capable of solving all the problems mentioned in the foregoing, and can exhibit extremely superior electrical, and photoconductive characteristics. Particularly, when this photoconductive member is used for electrophotographic image forming member, there can be obtained a high quality image which is excellent in its charge bearing capability at the time of charging treatment, stable in its electrophotographic characteristics even in a highly humid atmosphere, highly sensitive to light, excellent in its anti-photo-fatigue property and repetitive use, high in its density, capable of producing clear half tone, and has high resolution. Further, when this photoconductive member is used for the electrophotographic image forming member, the a-Si:X of high dark resistance exhibits a low photosensitivity, while the a-Si:X of high photo-sensitivity exhibits its dark resistance as low as $10^8$ ohm-cm or so. Therefore, in either case of using the photoconductive member having high dark resistance or high photo-sensitivity, the photoconductive layer of the conventional structure could not adopt a-Si:X for the electrophotographic image forming member as it is. In contrast to this, the photoconductive layer of the present invention can be constructed with the a-Si:X of a relatively low resistance ($5\times10^9$ ohm-cm and above), hence the a-Si:X having a relatively low resistivity but high photo-sensitivity is sufficiently useful and restrictions imposed on the characteristics of the a-Si:X can be reduced.

The optimum combinations of the a-Si:X from among those in Table 1 for the purpose of the present invention are the types C and F, in which cases the photoconductive member possesses highly excellent electrophotographic characteristics, so that when it is used as the electrophotographic image forming member, the best results can be obtained.

In the present invention, when the photoconductive layer and the barrier layer are laminated as mentioned in the foregoing, the a-Si:X of a lower resistance than that of the conventional ones can be used to constitute the photoconductive layer. In order, however, to obtain more favorable result, the dark resistance of the photoconductive layer to be formed should desirably be $8\times10^9$ ohms-cm and above, or optimumly, $1\times10^{10}$ ohms-cm and above.

The barrier layer, on the other hand, is constructed with a material having small mobility ($\mu$) to minority carriers so that injection into the photo-conductive layer of photo-carriers having the same polarity as that of the minority carriers in the barrier layer from the side of the substrate may be effectively inhibited, and that, of the photo-carriers to be generated in the photo-conductive, layer by irradiation of electromagnetic waves, those photo-carriers having the same polarity as that of majority carriers in the barrier layer may be effectively propagated through the photoconductive layer.

Further, when the barrier layer and the photoconductive layer are laminated in those combinations as shown in Table 1, there is created a depletion layer region at a interfacial region between them. In this instance, the lower limit of the barrier layer thickness is so restricted that one end of this depletion layer region may not reach, to a substantial extent, the barrier layer surface opposite to the junction between it and the photoconductive layer. The lower limit of thickness of the barrier layer is determined on the basis of thickness of the depletion layer to be created. However, since the thickness of the depletion layer depends on field intensity relative to the depletion layer and impurity concentration in both photoconductive layer and barrier layer to be junctioned, the lower limit of thickness of the barrier layer can also be determined from those values of the impurity concentration and the field intensity so that the photoconductive member having desired characteristics may be formed.

In the present invention, the lower limit of thickness of the barrier layer is determined as mentioned above. Specific values of the layer thickness for attaining the intended purpose of the present invention should preferably be 0.02 micron in ordinary case, and, more preferably 0.05 micron.

The upper limit of thickness of the barrier layer also makes one of the important factors to effectively attain the objective of the present invention. If the thickness of the barrier layer is sufficiently large, mobility of the majority carriers to be generated in and propagated through the barrier layer adversely affects mobility in the photoconductive layer of the photo-carriers having the same polarity as that of the majority carriers in the barrier layer and to be generated in the photoconductive layer by irradiation of electromagnetic waves. This results in inability of the photoconductive layer to effectively achieve its functions. Accordingly, the upper limit of thickness of the barrier layer should be so determined that such adverse effect as mentioned above may not substantially take place, or, if any, may almost be neglected. For the upper limit of thickness of the barrier layer, it should desirably be 0.5 micron in ordinary case, or more desirably 0.3 micron.

The layer thickness of the photoconductive layer for the photoconductive member according to the present invention may be appropriately determined as desired in conformity to the purpose, for which the photoconductive member is used, such as reading device, image pick-up device, electrophotographic image forming member, and so forth. In other words, the layer thickness of the photoconductive layer according to the present invention should appropriately be determined in relation to the layer thickness of the barrier layer so that the functions of the photoconductive layer and the barrier layer may be made much use of, and that the purpose of the present invention may be effectively attained. In ordinary case, the layer thickness should preferably be some tens of times as thick as that of the barrier layer. More specifically, it should desirably be in a range of from 1 to 70 microns, or more desirably from 2 to 50 microns.

Examples of halogen atom (X) contained in a photoconductive layer and a barrier layer according to the present invention are fluorine, chlorine, bromine and iodine, in particular, preferred fluorine and chlorine.

It is to be noted here that the expression "X is contained in the layer" signifies "a state, in which X is combined with silicon" or "a state in which X is ionized and taken into the layer", or "a state, in which $X_2$ are taken in the layer", or combination of these states.

In the present invention, a layer comprising a-Si:X is formed by a vacuum decomposition process using discharge phenomenon such as the glow discharge process, the sputtering process or the ion-plating process. For example, when a layer of the a-Si:X series is formed by the glow discharge process, a starting material gas for introducing X atom is introduced with a starting material gas for generating Si atom, which can generate Si atom, into a deposition chamber which can be evacuated, and glow discharge is generated in the deposition chamber to form a layer comprising a-Si:X on surface of a desired substrate fixed in the chamber. In the case of the sputtering process, a starting material gas for introducing halogen is introduced into a deposition chamber for the sputtering process, wherein the sputtering is effected by using silicon as a target in an atmosphere of an inactive gas such as argon or helium, etc. or a mixture gas with such inactive gas as a base.

Examples of a starting material gas for generating Si atom, which can be used in the present invention, are: hydrogenated silicon (silanes) in a gaseous form or in a readily gassifiable form such as $SiH_4$, $Si_2H_6$, $Si_3H_8$, $Si_4H_{10}$, etc., in particular, $SiH_4$ and $Si_2H_6$ are preferable based on easy handling on a procedure for forming layer and good effectiveness of generating Si.

Many halogen compounds can be effectively used for a starting material gas for introducing X atom in the present invention. Preferable compounds are halogen compounds in a gaseous form or in a readily gassifiable form such as halogen gas and interhalogenic compound.

Further, silicon compound containing halogen in a gaseous form or in a readily gassible form, which Si and halogen can be simultaneously obtained, can be effectively used in the present invention.

Concrete examples which can be preferably used in the present invention are: halogen gas such as fluorine, chlorine, bromine and iodine, interhalogenic compounds such as $SF_4$, $SF_6$, BrF, ClF, $ClF_3$, $BrF_5$, $BrF_3$, $IF_7$, $IF_5$, ICl, IBr, and the like.

Concrete examples which can be preferably used in the present invention are: halogenated silicon compounds such as $SiF_4$, $Si_2F_6$, $SiCl_4$, $SiBr_4$, and the like.

In the case that a photoconductive member according to the present invention is formed by the glow discharge process using a silicon compound containing halogen, a process that a layer comprising a-Si:X is formed by the glow discharge process introducing the abovementioned hydrogenated silicon gas with halogen compound into a deposition chamber under control is more preferable than a process that a layer comprising a-Si:X is formed on a desired substrate without using hydrogenated silicon gas as a starting material gas capable of generating Si, from the standpoint that X contents introduced into a layer to be formed can be exactly controlled.

In the case of producing a photoconductive member of the present invention by the glow discharge process, essentially, a hydrogenated silicon gas being a starting material gas for generating Si atom and a halogen compound gas for introducing X atom are introduced in a deposition chamber forming a layer comprising a-Si:X in such manner that mixing ratio and flow rate of two gases mentioned above are controlled in the predetermined state. Then, the plasma atmosphere of these gases is formed by generating glow discharge to form a layer comprising a-Si:X on the predetermined substrate. The layer may be formed by mixing gas of silicon compound containing halogen with the abovementioned gases. Each gas may be used not only as a single species, but as a mixture of plural gases. For forming a layer comprising a-Si:X by the sputtering process or the ion-plating process, in the case of the sputtering process, a turget comprising Si is subjected to sputtering in a plasma atmosphere of the predetermined gas, in the case of the ion-plating process, polycrystalline- or monocrystalline-silicon is accommodated in a deposition boat as a evaporating source, and the silicon evaporating source is heated by resistance heating or by the electron beam process (EB process) to fly and pass evaporating materials through a gas plasma atmosphere.

In the case of the sputtering process or the ion-plating process, introduction of halogen into a layer to be formed can be carried out by introduction of gas of the abovementioned halogen compound or silicon compound containing halogen into a deposition chamber and by forming the plasma atmosphere of the abovementioned gas.

In the present invention, the abovementioned halogen gases or silicon compounds containing halogen can be effectively used as a starting material gas for introducing X atom. Other effective compounds are halides, in which hydrogen is one of the constituent members, in a gaseous form or in readily gassifiable form. Examples of the halides are a halogenated hydrogen such as HF, HCl, HBr, HI, and the like, and a halogenated silane such as $SiH_2F_2$, $SiH_2Cl_2$, $SiHCl_3$, $SiH_2Br_2$, $SiHBr_3$, and the like.

These compounds containing hydrogen atom (H) are preferably used as starting material gases for introducing X atom, since the introduction of hdyrogen into a layer, which very effectively govern electric and photoelectric characteristics of the layer, can be simultaneously with the introduction of halogen into the layer upon forming the layer.

For the purpose of structurally introducing hydrogen atom into a layer comprising a-Si:X, $H_2$ or hydrogenated silicon such as $SiH_4$, $Si_2H_6$, $Si_3H_8$, $Si_4H_{10}$, and the like other than the abovmentioned compounds containing hydrogen and halogen can be used, that is, the structural introduction can also be carried out by generating discharge in a deposition chamber containing gas of $H_2$ or the abovementioned hydrogenated silicon with silicon or silicon compound for forming a-Si:X.

For example, in the case of the sputtering process, Si-target is used, and a starting material gas for introducing halogen atom (X) and $H_2$ gas, if necessary, inactive gas such as Ar and the like is mixed, are introduced into a deposition chamber. Then, a plasma atmosphere is formed to sputter the Si-target. By the above-mentioned procedure is obtained a layer comprising a Si:X having the desired characteristics, which H is introduced, on a surface of a substrate.

According to knowledge and finding of the present inventors, it has been found that the halogen atom content in the photoconductive layer and the barrier layer constitutes one of the important factors to govern applicability, in the practical aspect, of the resulting photoconductive member, hence it is of extreme significance.

In order that the photoconductive member to be obtained may be sufficiently applicable in the practical aspect, the halogen content in the photoconductive layer or the barrier layer should desirably range from 1 to 40 atomic %, or more preferably from 2 to 20 atomic %.

In the present invention, when H is contained in the photoconductive layer or the barrier layer to be formed, the H content is suitably determined according to the desire depending upon the halogen content to be contained to obtain desired characteristics. Generally, the H content is controlled in such manner that the sum of the H content and halogen content presents the above-mentioned range in case that halogen is alone contained.

In the present invention, when H is contained in layers to be formed, the H content is desirably determined in the relationship between the H- and halogen-contents. In general, the H content is not more than twice the halogen content, preferably not more than the halogen content, more preferably not more than half the halogencontent.

In the following, the present invention will be explained with reference to a case, wherein the photoconductive member is used as the electrophotographic image forming member to be adopted for effecting the electrophotographic method.

Figure 2:
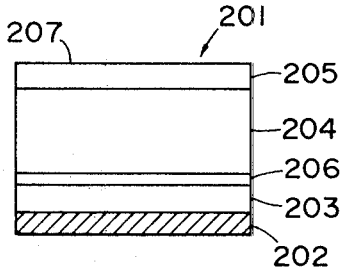

FIG. 1 and 2 illustrate representative structures of the electrophotographic image forming members. The member 101 shown in FIG. 1 comprises a substrate 102 for the image forming member, a barrier layer 103 provided on the substrate, and a photoconductive layer 104 having a free surface 106. The photoconductive layer 104 is sensitive to electromagnetic waves irradiated thereonto and produces mobile photo-carriers by excitement of the electromagnetic waves. The barrier layer 103 is capable of effectively inhibiting injection into the photoconductive layer 104 of the carriers having the same polarity as that of minority carriers present in the photoconductive layer.

The photoconductive layer 104 has a function of generating the mobile photo-carriers by the action of the electromagnetic waves irradiated thereonto during the electromagnetic wave irradiating step which is one of the process steps for forming an electrostatic image in the image forming member 101.

A depletion layer 105 is created at an interfacial region at the junction of the barrier layer 103 and the photoconductive layer 104.

The substrate 102 may be either electrically conductive or electrically insulative. Examples of the electrically conductive substrate are: metals such as NiCr, stainless steel, Al, Cr, Mo, Au, Ir, Nb, Ta, V, Ti, Pt, Pd, and so forth, or alloys of these metals. Examples of the electrically insulative substrate are: film or sheet of synthetic resins such as polyester, polyethylene, polycarbonate, cellulose acetate, polypropylene, polyvinyl chloride, polyvinylidene chloride, polystyrene, polyamide, and so forth. Besides these, there may usually be used glass, ceramics, paper, etc. It is desirable that these electrically insulative substrate be preferably subjected to electrically conductive treatment on at least one surface side thereof, and other layer be provided on this electrically conductive surface side. For instance, in the case of glass, its surface is subjected to electrically conductive treatment with a thin film of NiCr, Al, Cr, Mo, Au, Ir, Nb, Ta, V, Ti, Pt, Pd, $In_2O_3$, $SnO_2$, ITO ($In_2O_3$ and $SnO_2$), and so forth. In the case of the synthetic resin film such as polyester film, etc., its surface is treated with metals such as NiCr, Al, Ag, Pb, Zn, Ni, Au, Cr, Mo, Ir, Nb, Ta, V, Ti, Pt, and so forth by means of the vacuum evaporation method, the electron beam evaporation method, sputtering method, and so on. Or, the abovmentioned metals are laminated on one surface of the electrically insulative substrate to render it electrically conductive.

The shape of the substrate may be arbitrarily determined as desired such as in the the form of cylinder, belt, flat plate, etc. In the case of continuous, high speed reproduction, it is desirable that the substrate is in an endless belt form or cylindrical form.

Thickness of the substrate may be arbitrarily determined so as to obtain the image forming member as desired. In case, however, the image forming member is required to have flexibility, it should be made as thin as possible within such an extent that its function as the substrate may be sufficiently preserved. In such case, the thickness may usually be 10 microns and above from the standpoint of manufacturing and handling of the substrate as well as its mechanical strength, etc.

FIG. 2 illustrates the electrophotographic image forming member 201 of a different layer structure. This image forming member is not essentially different in structure from the electrophotographic image forming member 101 shown in FIG. 1 with the exception that the surface coating layer 205 is provided on the surface of the photoconductive layer 204. In other words, the electrophotographic image forming member 201 in FIG. 2 is composed of the substrate 202, on which the barrier layer 203 and the photoconductive layer 204 are laminated in the order as mentioned, the depletion layer 206 being created at the interfacial region between the barrier layer 203 and the photoconductive layer 204 at their junction. Materials for forming these layers, conditions for their fabrication, thickness of these layers, and so forth are same as in the case of the image forming member shown in FIG. 1. The characteristics required of the surface coating layer 205 provided on the photoconductive layer 204 differs from one electrophotographic process to another to be adopted. For example, when the electrophotographic process such as the NP-process as taught in U.S. Pat. No. 3,666,363 and U.S. Pat. No. 3,734,609 is adopted, the surface coating layer 205 is required to be electrically insulative, has sufficient electrostatic charge bearing capability when it is subjected to the charging process, and has a layer thickness of a certain degree or above. However, when the electrophotographic process such as, for example, the Carlson process, is adopted, the electric potential at the bright portion of the image after formation of an electrostatic image should desirably be very small, hence thickness of the surface coating layer 205 is required to be very thin. In addition to its satisfying desired electrical characteristics, the surface coating layer 205 may be formed in consideration of its not giving chemical and physical defects to the photoconductive layer 204, of its electrical contact property and adhesive property to the layer 204, and further of its moisture-resistant property, abrasion resistant property, cleaning property, etc.

Representative examples of the forming material to be effectively used for the surface coating layer 205 are polyethylene terephthalate, polycarbonate, polypropylene, polyvinyl chloride, polyvinyl chloride, polyvinyl alcohol, polystyrene, polyamide, polytetrafluoroethylene, polytrifluoroethylene chloride, polyvinyl fluoride, polyvinylidene fluoride, copolymers of hexafluoroethylene and tetrafluoroethylene, copolymers of trifluoroethylene and vinylidene fluoride, polybutene, polyvinyl butyral, polyurethane, poly-para-xylylene, and other organic insulative substances; and silicon nitrides, silicon oxides and other inorganic insulative substances. These resins or cellulose derivatives may be shaped into a film form and adhered onto the photoconductive layer 204, or they are rendered liquid, and coated on the photoconductive layer 204 for the layer formation. Thickness of the surface coating layer 205 may be arbitrarily determined depending on the characteristics as desired, or the quality of the material to be used. Usually, it ranges from 0.5 to 70 microns or so. In particular, where the surface coating layer 205 is required to have the function as the afore-mentioned protective layer, the thickness may be 10 microns or below in the ordinary case, and, where it is required to have the function as the electrically insulative layer, the thickness may be 10 microns or above in the ordinary case. It should, however, be noted that the value of the layer thickness to distinguish the protective layer and the electrically insulative layer is subject to variations due to the material to be used, the electrophotographic process to be adopted, and the structure of the image forming member to be designed, hence the above-mentioned value of 10 microns is not absolute. It should also be noted that the surface coating layer 205 will expand its function and effect when it is given an additional function as a reflection preventive layer.

For the purpose of effectively utilizing its characteristics, the image forming member according to the present invention is subjected to the charging treatment on its free surface, when an electrostatic image is to be formed by the Carlson process, by selecting a charge polarity in such a manner that a voltage which constitutes a reverse bias (a bias voltage in the reverse direction) may be applied to the depletion layer 206. When the electrostatic image is to be formed by the NP process, the image forming member is subjected to the charging treatment on its free surface by selecting a charge polarity in such a manner that a voltage which constitutes a forward bias (a bias voltage in the forward direction) may be applied to the depletion layer 206, followed by selection of a charge polarity opposite to that in the first step.

Since, according to the present invention, the photoconductive layer (104, 204) and the barrier layer (103, 203) are made of the same material, and the depletion layer (105, 206) is created at the junction of the barrier layer and the photoconductive layer, there is further derived an advantage such that the layers can be formed in a continuous manufacturing steps.

The abovementioned description is based on the case that the photoconductive layer and the barrier layer comprise with a-Si:X of types (1)–(5), however the present invention is not restricted with such layer structure.

The constitutions as follows may be useful. When the barrier layer comprises a-Si:X of type (2) or (4), or when the photoconductive layer comprises a-Si:X of type (1), (3) or (5), the other layer comprises a-Si:H of the types described below (6)–(10), in which halogen atom is not contained as a constituent atom.

In other words, when the barrier layer comprises a-Si:X of type (2) or (4), the photoconductive layer comprises a-Si:H of type (6), (8) or (10). When the photoconductive layer comprises a-Si:X of type (1), (3) or (5), the barrier layer comprises a-Si:H of type (7) or (9).

(6) $p^-$-type a-Si:H . . . containing acceptor alone at a low concentration, or both donor and acceptor with the concentration (Na) being slightly higher than the donor concentration;

(7) $p^+$-type a-Si:H . . . containing the acceptor alone at a concentration higher than that of the type (6), or both donor and acceptor with the acceptor concentration (Na) being higher than the donor concentration (Nd), and the donor concentration per se being considerably high;

(8) $n^-$-type a-Si:H . . . containing the donor alone at a low concentration, or both donor and acceptor with the donor concentration (Nd) being slightly higher than the acceptor concentration (Na);

(9) $n^+$-type a-Si:H . . . containing the donor alone at a concentration higher than that of the type (8), or both donor and acceptor with the donor concentration (Nd) being higher than the acceptor concentration (Na), and the donor concentration (Nd) per se being considerably high; and

(10) i-type a-Si:H . . . having a relationship of Na≃ND≃O or Na≃Nd.

The method for introducing hydrogen into the layers to be formed is as follows: at the time of forming these layers, a silicon compound such as silanes like $SiH_4$, $Si_2H_6$, $Si_3H_8$, $Si_4H_{10}$, etc. is introduced into a deposition device, and then the compound is decomposed by a process such as the thermal decomposition process or the glow discharge decomposition process, whereby hydrogen is contained in the layers along with their growth.

In case the layer comprising a-Si:H is formed by the glow discharge process, hydrogen is automatically included in the layer, when the layer is formed from the starting material of a-Si, due to decomposition of hydrogenated silicon gas such as $SiH_4$, $Si_2H_6$, etc.

In the case of the reactive sputtering method, it may suffice that hydrogen gas, or a hydrogenated silicon gas such as $SiH_4$, $Si_2H_6$, $Si_3H_8$, $Si_4H_{10}$, etc., or a gas such as $B_2H_6$, $PH_3$, etc. for dual purposes of introducing hydrogen as well as doping impurity is introduced into a deposition chamber, wherein the sputtering is effected by using silicon as a target in an atmosphere of an inactive gas such as argon, etc. or a mixture gas with such inactive gas as a base.

In order that the photoconductive member to be obtained may be sufficiently applicable in the practical aspect, the hydrogen content in the layer to be obtained should desirably range from 1 to 40 atomic %, or more preferably from 5 to 30 atomic %. In the present invention, the impurity as dopant is selected from those atoms in Group III-A of the Periodic Table such as, for example, B, Al, Ga, In, Tl, etc. as the acceptor forming impurity, and those atoms in Group V-A of the Periodic Table such as, for example, N, P, As, Sb, Bi, etc. as the donor forming impurity.

When each layer is made of a-Si:X or a-Si:(H+X) (containing both hydrogen atom and halogen atom), the doping quantity of these impurity is determined by following the desire as follows. The doping quantity of these impurities into each layer should preferably range, in ordinary case, from 50 ppm to 1,000 ppm, or more preferably, from 100 ppm to 500 ppm of the atoms in Group III-A of the Periodic Table as the p-type impurity to render the layer to be of $p^+$-type. For obtaining the $n^+$-type, the atoms in Group V-A of the Periodic Table may be doped as the n-type impurity in an amount of from 50 ppm to 1,000 ppm, or more preferably, from 100 ppm to 500 ppm. To obtain the photoconductive layer of the types of $p^-$-type, $n^-$-type, and i-type, respectively, no impurity to govern the conductivity type is doped, or the p-type impurity is doped in an amount not reaching 50 ppm. Distinction amount the $p^-$, $n^-$, and i conductivity types depends on the manufacturing conditions, and they gradually change from the $n^-$-type to the i-type, and further to the $p^-$-type in the abovementioned region of the doping quantity.

In case that each layer is made of a-Si:H, the doping quantity of these impurities into each layer should preferably range, in ordinary case, from 100 ppm to 1,000 ppm, or more preferably, from 150 ppm to 500 ppm of the atoms in Group III-A of the Periodic Table to render the layer to be of the $p^+$-type. For obtaining the $n^+$-type, the atoms in Group V-A of the Periodic Table may be doped as the n-type impurity in an amount of from 100 ppm to 1,000 ppm, or more preferably, from 150 ppm to 500 ppm. To obtain the photoconductive layer of the types $p^-$-type, $n^-$-type, and i-type, respectively, no impurity to govern the conductive type is doped, or the p-type impurity is doped in an amount not reaching 100 ppm.

In order that the photoconductive member of the present invention may operate more effectively, it is desirable that the ratio between the doping quantity in the photoconductive layer and that in the barrier layer be set as follows.

In all cases that each layer is made of a-Si:X, a-Si:(H+X) or a-Si:H, for a value satisfying a relationship of N−M/N (where M (ppm) is a doping quantity of the impurity governing the conductivity in the photoconductive layer, and N (ppm) is a doping quantity of the impurity governing the conductive type in the barrier layer), a range of 0.5 to 1.0 in an ordinary case, or more preferably from 0.75 to 1.0, or optimumly from 0.9 to 1.0, is selected.

EXAMPLE 1

Figure 3:
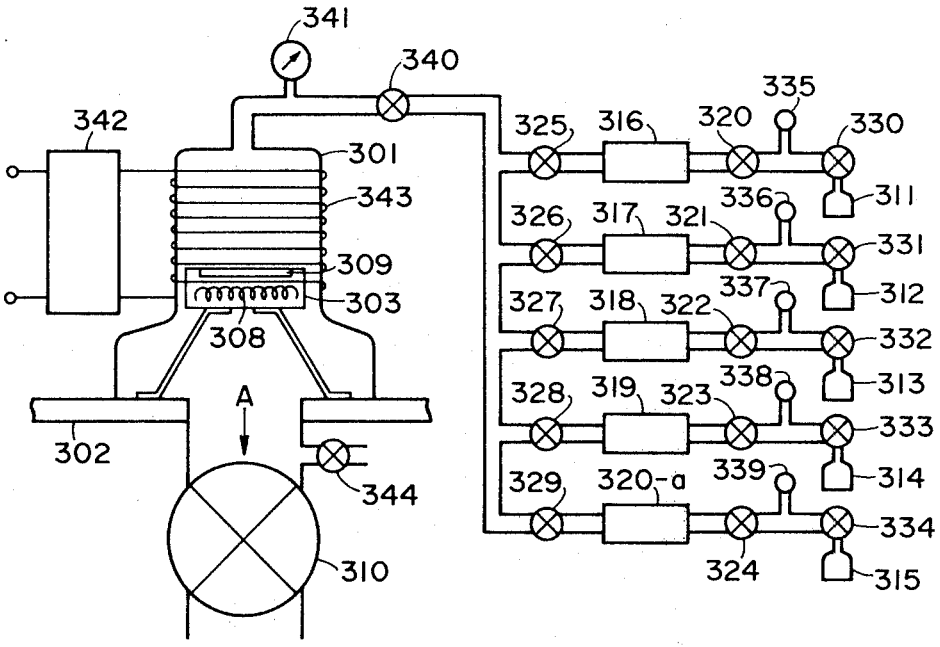
FIGS. 3 and 4 are schematic explanatory diagrams of the devices for fabricating the photoconductive member according to the present invention.

In accordance with the procedure described below, an electrophotographic image forming member of the present invention was prepared by using an apparatus as illustrated in FIG. 3, which was set up in a clean room completely shielded.

Surfaces of molybdenum plate (substrate) 309 of 0.5 mm in thickness and 10 cm×10 cm in size were cleaned. The cleaned substrate was firmly disposed on fixing member 303 placed at a predetermined position in deposition chamber 301 for glow discharge, which was allowed to stand on support 302. Substrate 309 was heated by heater 308 placed in fixing member 303 in accuracy of ±0.5° C. Determination of temperature was carried out in such manner that a temperature of back size of the substrate was directly determined by a thermocouple (chromel-alumel). After it was confirmed that all valves in the system were closed, main valve 310 was fully opened. The air in chamber 301 was evacuated to bring the chamber to a vacuum degree of about $5\times10^{-6}$ Torr. Thereafter the input voltage of heater 308 was raised. The input voltage was changed with detecting a temperature of molybdenum substrate, the temperature was stabilized at a constant value of 200° C.

Thereafter, auxiliary valve 340 was fully opened, subsequently outflow valves 325, 326 and 327, inflow valves 320, 321 and 322 were fully opened to evacuated thoroughly the inside of flowmeters 316, 317 and 318. After auxiliary valve 340, and valves 325, 326, 327, 320, 321 and 322 were closed, valve 330 of bomb 311 containing $SiF_4$ (purity 99.999%) and valve 331 of bomb 312 containing hydrogen were opened to adjust the pressures of outlet pressure gauges 335 and 336 to 1 Kg/cm$^2$. Inflow valves 320 and 321 were gradually opened so that $H_2$ gas was allowed to flow into flowmeters 316 and 317. Subsequently, outflow valves 325 and 326 were gradually opened, then auxiliary valve 340 was gradually opened. Inflow valves 320 and 321 were adjusted so that the flow rate ratio of $SiF_4$ gas to $H_2$ gas might be 10:1. The opening of auxiliary valve 340 was adjusted with watching the reading of pirani gauge 341 to bring the vacuum degree of chamber 301 to $1\times10^{-2}$ Torr. After stabilization of the vacuum degree of chamber 301, main valve 310 was gradually closed to bring the indication of pirani gauge 341 to 0.5 Torr.

Further, $B_2H_6$ gas was mixed with $SiF_4$ gas and $H_2$ gas and allowed to flow from bomb 313 containing $B_2H_6$ gas through valve 332 into chamber 301 while inflow valve 322 and outflow valve 327 were adjusted under the pressure of 1 Kg/cm$^2$ (the reading of outlet pressure gauge 337) so that the flow rate of $B_2H_6$ gas might be 0.02% by volume per that of $SiF_4$ gas based on the reading of flowmeter 318. After it was confirmed that the inflow of gases and the pressure of chamber 301 were stabilized, the switch of high frequency power source 342 was turned on in order to apply a high frequency voltage of 13.56 MHz to induction coil 343 to generate glow discharge in chamber 301. The input power was 10 W. The foregoing condition was kept for four minutes to form a barrier layer in order to deposite a-Si:X on the substrate. Thereafter, high frequency power source 342 was turned off. Under the condition that glow discharge was discontinued, inflow valve 322 and outflow valve 327 were adjusted so that the reading of flow meter 318 might be 0.0005% by volume based on the flow rate of $SiF_4$ gas, and the opening of outflow valve 327 was fixed to stabilized the flow rate of $B_2H_6$ gas.

Subsequently, high frequency power source 342 was again turned on to reopen the glow discharge. After the glow discharge was continued for three hours to form a photoconductive layer, heater 308 and high frequency power source 342 were turned off. After the temperature of the substrate was brought to 100° C., outflow valves 325, 326 and 327, and inflow valves 320, 321 and 322 were closed, but main valve 310 was fully opened to bring the pressure of chamber 301 to $10^{-5}$ Torr or below. Thereafter, main valve 310 was closed, and leak valve 343 was opened to bring the pressure in chamber 301 to atmospheric pressure. The substrate was then taken out. The formed layer had a total thickness of about nine microns. The obtained image-forming member was set in an apparatus for charge exposure experiment. To the imageforming member was applied corona charge with a voltage of ±6.0 KV for 0.2 sec., immediately an optical image was projected. An optical image exposure was conducted by the light source of a tungsten lamp through a test chart of a transmission type in an amount of 0.8 lux·sec.

Immediately, a developer (containing a toner and a carrier) having negative charge was allowed to cascade on the surface of the image forming member to obtain a good toner image on the surface of the image forming member. The toner image obtained on the image forming member was transferred to a transfer paper by corona charge of −5.0 KV, to obtain a clear image having good reproducibility of gradation and high density.

EXAMPLE 2

An electrophotographic image forming member having a barrier layer and a photoconductive layer on molybdenum substrate was obtained in a similar manner and conditions to that described in Example 1 except that the flow rate of $B_2H_6$ gas is 0.01% by volume based on the flow rate of $SiF_4$ and that the glow discharge was continued for six minutes to form the barrier layer on the molybdenum substrate.

An image forming procedure was carried out by using the obtained electrophotographic image forming member in the same conditions and manner as in Example 1 to obtain an excellently clear image having high resolving power on a transfer paper.

EXAMPLE 3

A molybdenum substrate was disposed in the same manner as in Example 1, subsequently deposition chamber 301 for glow discharge was evacuated to bring a vacuum degree of $5\times10^{-6}$ Torr in the same manner as in Example 1. After the temperature of the substrate was kept at 300° C., the gas inflow system for $SiF_4$, $H_2$ and $B_2H_6$ was evacuated to bring to vacuum degree of $5\times10^{-6}$ Torr. Thereafter, auxiliary valve 340, outflow valves 325, 326 and 327, and inflow valves 310, 321 and 322 were closed. Then, valve 330 of bomb 311 containing $SiF_4$, valve 331 of bomb 312 containing $H_2$, and valve 332 of bomb 313 containing $B_2H_6$ were opened, and each pressure of outflow gauges 335, 336 and 337 was adjusted to 1 Kg/cm$^2$. Inflow valves 320, 321 and 322 were gradually opened so that $SiF_4$, $H_2$ and $B_2H_6$ might be allowed to flow to flowmeters 316, 317 and 318, respectively. Subsequently, outflow valves 325 and 326 were gradually opened, and then auxiliary valve 340 was gradually opened. At this time, inflow valves 320 and 321 were controlled so that the flow rate of $SiF_4$ gas might be 10:1 to that of $H_2$ gas. Then, the opening of auxiliary valve 340 was controlled with watching the reading of pirani gauge 341 so that the pressure in chamber 301 might be brought to $1\times10^{-2}$ Torr. After the pressure in chamber 301 was stabilized, main valve 310 was gradually closed so that the indication of pirani gauge 341 might be brought to 0.5 Torr. At this time, $B_2H_6$ gas was mixed with $SiF_4$ gas and $H_2$ gas and allowed to flow from bomb 312 containing $B_2H_6$ gas through valve 332 into chamber 301 while inflow valve 332 and outflow valve 327 were adjusted under the pressure of 1 Kg/cm$^2$ (the reading of outlet pressure guage 337). The inflow of gases was stabilized, the pressure of the chamber became constant, and the temperature of the substrate was stabilized at 300° C., thereafter high frequency power source 342 was turned on to start the glow discharge. After the foregoing condition was kept for four minutes to form a barrier layer on the substrate, high frequency power source was turned off to discontinue the glow discharge. Under this condition, outflow valve 327 and inflow valve 322 were closed. Subsequently, high frequency power source 342 was again turned on to reopen the glow discharge. After the glow discharge was continued for five hours to form a photoconductive layer, heater 308 was turned off and high frequency power source 342 off. After the temperature of the substrate was brought to 100° C., outflow valves 325 and 326, and inflow valves 320 and 321 were closed, but main valve 310 was fully opened to bring the pressure in the chamber to $10^{-5}$ Torr or below. Thereafter, main valve 310 was closed, and leak valve 343 was opened to bring the pressure in chamber 301 to atmospheric pressure. The substrate was taken out. The formed layer had a total thickness of about 15 microns.

To the thus prepared image forming member was applied positive corona discharge with a power source voltage of 6000 V in a dark place. Subsequently, an image exposure was conducted in an amount of 1 lux. sec. to form an electrostatic image. The electrostatic image was developed by use of a toner having negative charge in the cascade process. The obtained toner image was transferred onto a transfer paper and the transferred image was fixed to obtain an extremely clear image.

EXAMPLE 4

Ni Cr was deposited by the electron beam vacuum deposition process to the thickness of 1000 Å on one surface of Corning 7057 glass plate (1 mm thickness, 4×4 cm size, both surfaces being polished) whose surfaces were cleaned. The obtained substrate was firmly fixed on fixing member 303 of the same apparatus (FIG. 3) as described in Example 1 with the Ni Cr surface being faced upward. Subsequently, deposition chamber 301 for glow discharge was evacuated to bring to a vacuum degree of $5\times10^{-6}$ Torr in the same manner as in Example 1. After the temperature of the substrate was kept at 300° C., auxiliary valve 340, then outflow valves 325, 326, 327 and 328, and inflow valves 320, 321, 322 and 323 were fully opened to bring the inside of flowmeters 316, 317, 318 and 319 to sufficient vacuum. After auxiliary valve 340, and valves 325, 326, 327, 328, 316, 317, 318 and 319 were closed, valve 330 of bomb 311 containing $SiF_4$ gas, valve 331 of bomb 312 containing $H_2$ gas, valve 333 of bomb 314 containing $PH_3$ gas (purity 99.999%) were opened to adjust the pressure of outlet pressure gauges 335, 336 and 338 to 1 Kg/cm$^2$. Inflow valves 320, 321 and 323 were gradually opened to introduce $SiF_4$ gas, $H_2$ gas, and $PH_3$ gas into flowmeters 316, 317 and 319, respectively. Subsequently, outflow valves 325 and 326 were gradually opened. At this time, inflow valves 320 and 321 were adjusted so that ratio of the flow rate of $SiF_4$ gas to that of $H_2$ gas might be brought to 10:1. Then, the opening of auxiliary valve 340 was adjusted with watching the reading of pirani gauge 341 to bring the pressure of chamber 301 to $1\times10^{-2}$ Torr. After stabilization of the vacuum degree of chamber 301, main valve 310 was gradually closed to bring the indication of pirani gaugi 341 to 0.5 Torr. At this time, $PH_3$ gas was mixed with $SiF_4$gas and $H_2$ gas and allowed to flow into chamber 301 while inflow valve 323 and outflow valve 328 were adjusted so that the flow rate of $PH_3$ gas might be 0.025% by volume per the flow rate of $SiF_4$ gas based on the reading of flowmeter 319. After it was confirmed that the inflow of gases and the pressure of chamber 301 were stabilized, the switch of high frequency power source 342 was turned on in order to apply a high frequency power of 13.56 MHz to induction coil 342 to generate glow discharge in a coil portion (the upper portion of the chamber). The input power was 10 W. The foregoing conditions were kept for five minutes to form a barrier layer. Thereafter, high frequency power source 342 was turned off. Under the condition that the glow discharge was discontinued, outflow valve 328 and inflow valve 323 were closed for some time, then valve 332 of bomb 313 containing $B_2H_6$ gas was opened to adjust the pressure of outlet pressure gauge 337 to 1 Kg/cm$^2$. After inflow valve 322 was gradually opened to introduce $B_2H_6$ gas into flowmeter 318, outflow valve 327 was gradually opened and the opening of outflow valve 327 was set so that the flow rate of $B_2H_6$ might be brought to 0.002% by volume per that of silane gas based on the reading of flowmeter 318. Thus the flow of gases was stabilized.

Subsequently, high frequency power source 342 was against turned on, the glow discharge was reopened. The discharge was further continued for eight hours to form a photoconductive layer, thereafter heater 308 was turned off and high frequency power source off. After the temperature of the substrate was brought to 100° C., outflow valves 325, 326 and 327, and inflow valves 320, 321 and 322 were closed, but main valve 310 was fully opened to bring the pressure in chamber 301 to $10^{-5}$ Torr or below. Thereafter main valve 310 was closed, and leak valve 343 was opened to bring the pressure in chamber 301 to atmospheric pressure. The substrate was then taken out. The formed layer has a total thickness of about 23 microns.

The obtained image forming member was set in a test apparatus for charge exposure in the same manner as in Example 1 to effect an image forming test. As a result, a toner image having excellent quality and high contrast was obtained on a transfer paper by combining a corona discharge of −5.5 KV and a developer having positive charge.

EXAMPLE 5

On a molybdenum substrate, a procedure for forming a barrier layer was carried out for four minutes, and a procedure for forming a photoconductive layer for five hours in the same condition and manner as in Example 1 to form a layer having a total thickness of 14 microns. Thereafter, the obtained image forming member was taken out from chamber 301. Polycarbonate resin was applied on the photoconductive layer so as to obtain an electrically insulating layer having a thickness of 15 microns after drying. Thus an electrophotographic image forming member was obtained. To the insulating surface of the obtained image forming member was applied corona discharge with a power source voltage of 5500 V as the primary charging for 0.2 sec. so that the surface might be charged to a voltage of −2000 V. Positive corona discharge with a power source voltage of 6000 V was carried out as the secondary charging simultaneously with the image exposure in an exposure quantity of 0.6 lux·sec., and the whole surface of the image forming member was then uniformly exposured to form an electrostatic image. This electrostatic image was developed with a positively charged toner by the cascade method. The obtained toner image was transferred to a transfer paper and fixed to obtain an image having extremely excellent quality.

The quality of the initial image was maintained even when the foregoing procedure was continuously repeated for more than 100,000 sheets.

EXAMPLE 6

A molybdenum substrate was disposed in the same manner as in Example 1, subsequently deposition chamber 301 for glow discharge was evacuate to bring to a vacuum degree of $5\times10^{-6}$ Torr in the same manner as in Example 1. After the temperature of the substrate was kept at 300° C., auxiliary valve 340, then outflow valves 325, 326, 327 and 329, and inflow valves 320, 321, 322 and 324 were fully opened to bring the inside of flowmeters 316, 317, 318 and 320 to sufficient vacuum. After auxiliary valve 340, and valves 325, 326, 327, 329, 320, 321, 322 and 324 were closed, valve 334 of bomb 315 containing $SiH_4$ gas, valve 331 of bomb 312 containing $H_2$ gas, and valve 322 of bomb 313 containing $B_2H_6$ gas were opened to adjust the pressure of outlet gauges 339, 337 and 336 to 1 Kg/cm$^2$. Inflow valves 324, 322 and 321 were gradually opened to introduce $SiH_4$ gas, $B_2H_6$ gas and $H_2$ gas into flowmeters 320*a*, 318 and 317, respectively. Subsequently, outflow valves 329 and 326 were gradually opened, and auxiliary valve 340 was then gradually opened. At this time, inflow valves 324 and 321 were adjusted so that ratio of the flow rate of $SiH_4$ gas to that of $H_2$ gas might be brought to 1:5. Then, the opening of auxiliary valve 340 was adjusted with watching the reading of pirani gauge 341 to bring the pressure of chamber 301 to $1\times10^{-2}$ Torr. After stabilization of the vacuum degree of chamber 301, main valve 310 was gradually closed to bring the indication of pirani gauge 341 to 0.2 Torr. At this time, $B_2H_6$ gas was mixed with $SiH_4$ gas and $H_2$ gas and allowed to flow into chamber 301 while inflow valve 322 and outflow valve 327 were adjusted so that the flow rate of $B_2H_6$ gas might be 0.035% by volume per the flow of $SiH_4$ gas based on the reading of flowmeter 318. After it was confirmed that the inflow of gases and the pressure in the chamber were stablized, the switch of high frequency power source 342 was turned on in order to apply a high frequency power of 13.56 MHz to induction coil 343 to generate glow discharge in a coil portion (the upper portion of the chamber). The input power was 10 W.

The foregoing conditions were kept for eight minutes to form a barrier layer. Thereafter, high frequency power source 342 was turned off. Under the condition that the glow discharge was discontinued, outflow valve 329 and inflow valve 324 were closed. Subsequently, a photoconductive layer comprising an amorphous material doped with boron was formed on the foregoing barrier layer comprising a-Si:H in the same manner as the procedure described in Example 1. Thus, the obtained layer had a total thickness of about nine microns.

The obtained image forming member was set in a test apparatus for charge exposure in the same manner as in Example 1 to effect an image forming test. As a result, a toner image having excellent quality and high contrast was obtained on a transfer paper by combining a corona discharge of +6.0 KV and a developer having negative charge.

EXAMPLE 7

Figure 4:
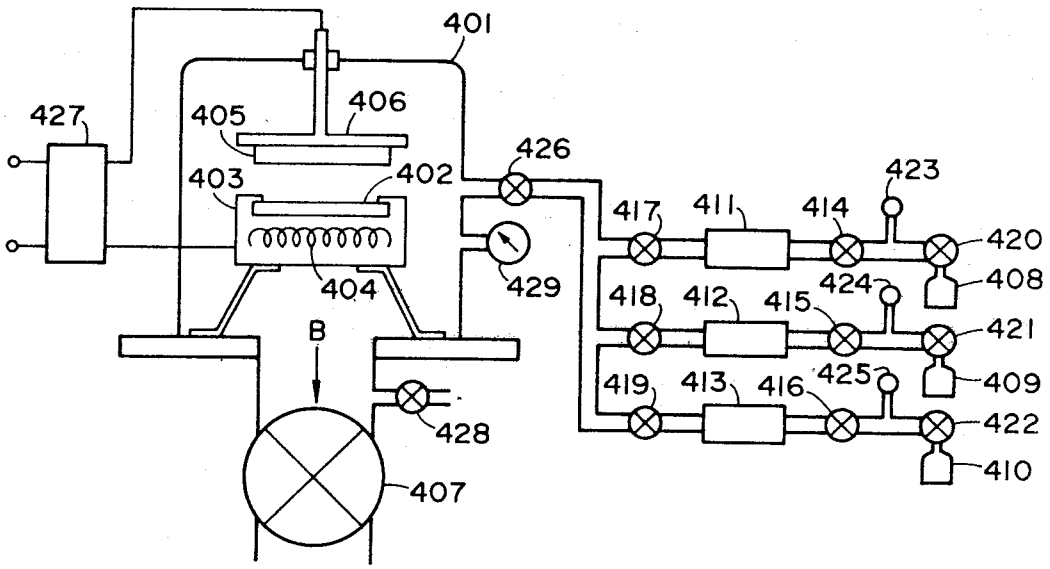

An electrophotographic image forming member was prepared by use of an apparatus illustrated in FIG. 4 in a manner described below.

A stainless-steel plate having a thickness of 0.2 mm and a size of 10×10 cm, whose surface was cleaned, was used as substrate 402 to be firmly disposed on fixing member 403 comprising heater 404 and a thermocouple, said member being placed in deposition chamber 401 for the sputtering process. A polycrystalline silicon plate (purity: 99.999%) target 405 was firmly disposed oposite to substrate 402 in parallel with and separate about 8.5 cm away from the substrate.

Deposition chamber 401 once was evacuated to about $1\times10^{-6}$ Torr. by fully opening main valve 407 (at this time, all other valves of this system being closed). Thereafter, auxiliary valve 426, and outflow valves 417, 418 and 419 were opened to fully evacuate flowmeters 411, 412 and 413. Then, outflowvalves 417, 418 and 419, and auxiliary valve 426 were closed.

The power source of the heater was turned on to regulate substrate 402 at 250° C. Then, valve 420 of bomb 408 containing $SiF_4$ (Purity: 99.99995%) was opened to adjust the outlet pressure to 1 Kg/cm$^2$ based on outlet pressure gauge 423. Subsequently, inflow valve 414 was gradually opened to introduce $SiF_4$ gas into flowmeter 411. Then, outflow valve 417 was gradually opened, and auxiliary valve 426 was further opened.

The outflow valve was adjusted to bring the pressure of deposition chamber 401 to $5\times10^{-4}$ Torr. while the pressure of the chamber was detected with pirani gauge 429. Subsequently, valve 421 of bomb 409 containing Ar (purity: 99.9999%) was opened and adjusted to bring the reading of outlet pressure gauge 424 to 1 Kg/cm$^2$. Then, inflow valve 415 was opened, and outflow valve 418 was gradually opened to introduce Ar gas into the deposition chamber. Outflow valve 418 was gradually opened to bring indication of pirani gauge 429 to $1\times10^{-3}$ Torr. After the flow of gases was stabilized at the foregoing state, main valve 407 was gradually closed and adjusted to bring the pressure of the chamber to $1\times10^{-2}$ Torr. Subsequently, valve 422 of bomb 410 containing $B_2H_6$ gas (purity: 99.9995%)was opened and adjusted to bring outlet pressure gauge to 1 Kg/cm$^2$. Then, inflow valve 416 was opened, and outflow valve 419 was opened and adjusted so that $B_2H_6$ gas might be allowed to flow at a flow rate of about 2.5% by volume per a flow rate of $SiF_4$ gas based on the reading of flowmeters 413 and 412, respectively. After it was confirmed that flowmeters 411, 412 and 413 were stabilized, high frequency power source 427 was turned on in order to apply a high frequency voltage of 13.56 MHz and 1 KV to between fixing members 403 and 406 (target 405). Matching was carried out so that stable discharge might be continued under the foregoing condition to form a layer. The discharge was continued for five minutes in the foregoing manner to form a barrier layer. Thereafter, high frequency power source 427 was turned off to discontinued the discharge for some time. Subsequently, outflow valve 419 and inflow valve 416 were adjusted so that the flow rate of $B_2H_6$ gas might be brought to 0.5% by volume per that of $SiF_4$ gas. After stabilization of gas flow rate of $SiF_4$, Ar and $B_2H_6$, high frequency power source 407 was again turned on in order to apply 10 KV to return the discharge. Under the conditions, the discharge was continued for six hours to form a photoconductive layer, thereafter, high frequency power source 427 and the power source of heater 404 were turn off. After the temperature of the substrate was brought to 100° C. or below, inflow valves 417, 418 and 419, and inflow valves 414, 418 and 419 were closed, and auxiliary valve 426 was closed, but main valve 407 was fully opened to evacuate the gas in the deposition chamber. Thereafter, main valve 407 was closed, but leak valve 428 was opened to leak the deposition chamber to atmospheric pressure. Then, the substrate was taken out. The formed layer had a total thickness of 13 microns.

The obtained image forming member was tested in the same manner as in Example 1 to obtain an image excellent in resolving power, gradation and image density by combining a corona discharge of +6.0 KV and a developer having negative charge.

EXAMPLE 8

Image forming members were prepared in a similar manner to that described in Example 7 except that a kind of gas and discharge conditions were altered as listed in Table 2. The obtained image forming members were tested in the same manner as in Example 1 to obtain images excellent in resolving power, gradation and image density by combining a corona discharge of +6 KV and a developer having negative charge. Sample 1 in Table 2 is the sample obtained in Example 7.

TABLE 2

| | Sample | Dilution Gas | Raw Material Gas and Flow Rate | Conditions of discharge |
|---|---|---|---|---|
| 1 | Barrier layer | Ar | $SiF_4:B_2H_6$ = 1:0.025 | 1 KV five minutes |
| | Photoconductive layer | Ar | $SiF_4:B_2H_6$ = 1:0.005 | 1 KV six hours |
| 2 | Barrier layer | $Ar:H_2$ = 1:1 | $SiF_4:B_2H_6$ = 1:0.030 | 1 KV five minutes |
| | Photoconductive layer | Ar | $SiH_4:B_2H_6$ = 1:0.007 | 0.8 KV six hours |
| 3 | Barrier layer | Ar | $SiH_4:B_2H_6$ = 1:0.025 | 1 KV ten minutes |
| | Photoconductive layer | $Ar:H_2$ = 1:1 | $SiF_4:B_2H_6$ = 1:0.002 | 1 KV ten hours |
| 4 | Barrier layer | Ar | $SiF_4:BF_3$ = 1:0.020 | 1 KV seven minutes |
| | Photoconductive layer | Ar | $SiF_4:BF_3$ = 1:0.002 | 1 KV five hours |
| 5 | Barrier layer | Ar | $SiH_4:B_2H_6$ = 1:0.040 | 1.2 KV three minutes |
| | Photoconductive layer | Ar | $SiF_4:BF_3$ = 1:0.001 | 1 KV three hours |
| 6 | Barrier layer | Ar | $SiF_4:BF_3$ = 1:0.030 | 1.5 KV four minutes |
| | Photoconductive layer | Ar | $SiH_4:B_2H_6$ = 1:0.005 | 1 KV six hours |

What we claim is:

1. A photoconductive member comprising a substrate for the photoconductive member, a photoconductive layer, and a barrier layer arranged between the substrate and the photoconductive layer, said barrier layer having a function which inhibits injection of carriers from the side of said substrate into said photoconductive layer, characterized in that at least one of said photoconductive layer and said barrier layer is made of an amorphous material in which silicon atom is a matrix and halogen atom is a constituent atom, a depletion layer region is created at the interfacial region between the photoconductive layer and the barrier layer, a part of said barrier layer is present between said depletion layer region and said substrate in a thickness capable of bringing substantially negligible probability which the carriers having the same polarity as that of the minor carriers in said barrier layer reaches said depletion layer region from the side of said substrate in order to inhibit injection of the carriers having the same polarity as that of the minor carriers in said barrier layer from the side of said substrate to said photoconductive layer, and the photocarriers having the same polarity as that of the major carriers in said barrier layer among photocarriers generating in said photoconductive layer by irradiation of an electromagnetic waves are moved in the direction of said barrier layer.

2. A photoconductive member according to claim 1, in which a barrier layer has semiconductive characteristics of $p^+$ type.

3. A photoconductive member according to claim 2, in which a barrier layer contains an atom in III A group of the periodic table as an impurity.

4. A photoconductive member according to claim 3, in which an impurity atom contained in a barrier layer ranges from 50 ppm to 1000 ppm.

5. A photoconductive member according to claim 1, in which a barrier layer has semiconductive characteristics of $n^+$ type.

6. A photoconductive member according to claim 5, in which a barrier layer contains an atom in V A group of the periodic table as an impurity.

7. A photoconductive member according to claim 6, in which an impurity atom contained in a barrier layer ranges from 50 ppm to 1000 ppm.

8. A photoconductive member according to claim 1, in which a barrier layer has a thickness of 0.02–0.5 microns.

9. A photoconductive member according to claim 1, in which a barrier layer is constructed with an amorphous material in which silicon atom is a matrix and hydrogen atom is a constituent atom.

10. A photoconductive member according to claim 9, in which hydrogen atom is contained in an amount of 1-40 atomic percent.

11. A photoconductive member according to claim 1, in which a barrier layer is constructed with an amorphous material in which silicon atom is a matrix and halogen atom is a constituent atom.

12. A photoconductive member according to claim 11, in which halogen atom is contained in an amount of 1-40 atomic percent.

13. A photoconductive member according to claim 1, in which a barrier layer is constructed with an amorphous material in which silicon is a matrix, and halogen and hydrogen atoms are constituent atoms.

14. A photoconductive member according to claim 13, in which halogen and hydrogen atoms are contained in an amount of 1-40 atomic percent as the whole sum and a hydrogen content is not more than twice a halogen content.

15. A photoconductive member according to claim 1, in which a photoconductive layer has at least one semiconductive characteristic selected from the group consisting of $n^-$ type, i type and $p^-$ type.

16. A photoconductive member according to claim 15, in which a photoconductive layer contains an atom in III A group of the periodic table in an amount not reaching 50 ppm as an impurity.

17. A photoconductive member according to claim 1, in which a photoconductive layer has a thickness of 1-70 microns.

18. A photoconductive member comprising a substrate for the photoconductive member, a photoconductive layer, and a barrier layer being present between the substrate and the photoconductive layer, said barrier layer having a function which inhibits injection of a carrier from the side of said substrate into said photoconductive layer, characterized in that at least one of said photoconductive layer and said barrier layer is constructed by amorphous material in which silicon atom is a matrix and halogen atom is a constituent, a depletion layer region is created at the interfacial region between the photoconductive layer and the barrier layer, said barrier layer having a thickness of 0.02-0.5 microns and containing in an amount of 50-1000 ppm of an impurity which governs the conductive type of the barrier layer, said impurity being an atom in III A or V A group of the periodic table, said photoconductive layer having a thickness of 1-70 microns and containing no impurity which governs the conductive type of the photoconductive layer or in an amount not reaching 50 ppm of said impurity being an atom in III A group of the periodic table, and when N represents a quantity of said impurity contained in said barrier layer and M represents a quantity of said impurity contained in said photoconductive layer, a value of (N-M)/M ranges from 0.5 to 1.0.

19. A photoconductive member according to claim 18, in which halogen atom is contained in an amount of 1-40 atomic percent.

20. A photoconductive member comprising a substrate for the photoconductive member, a photoconductive layer, and a barrier layer arranged between the substrate and the photoconductive layer, said barrier layer having a function which inhibits injection of carriers from the side of said substate into said photoconductive layer, characterized in that at least one of said photoconductive layer and said barrier layer is made of an amorphous material in which silicon atom is a matrix and halogen atom is a constituent atom, a depletion layer region is created at the interfacial region between the photoconductive layer and the barrier layer, said barrier layer containing an impurity which governs the conductive type of said barrier layer to inhibit injection of the carriers having the same polarity as that of the minor carriers in said barrier layer from the side of said substrate to said photoconductive layer, said photoconductive layer containing an impurity which governs the conductive type of said photoconductive layer or not containing such impurity, and theimpurity concentration to satisfy a relationship of (N-M)/N ranges from 0.5 to 1.0 wherein N is a quantity of the impurity contained in the barrier layer, and M is a quantity of the impurity contained in the pootoconductive layer.

21. A photoconductive member according to claim 20, in which a barrier layer has semiconductive characteristics of $p+$ type.

22. A photoconductive member according to claim 21, in which a barrier layer contains an atom in Group III of the Periodic Table as an impurity.

23. A photoconductive member according to claim 22, in which an impurity atom contained in a barrier layer ranges from 50 ppm to 1000 ppm.

24. A photoconductive member according to claim 20, in which a barrier layer has semiconductive characteristics of $n+$ type.

25. A photoconductive member according to claim 24, in which a barrier layer contains an atom in Group V of the Periodic Table as an impurity.

26. A photoconductive member according to claim 26, in which an impurity atom contained in a barrier layer ranges from 50 ppm to 1000 ppm.

27. A photoconductive member according to claim 20, in which a barrier layer has a thickness of 0.02-0.5 microns.

28. A photoconductive member according to claim 20, in which a barrier layer is constructed with an amorphous material in which silicon atom is a matrix and hydrogen atom is a constituent atom.

29. A photoconductive member according to claim 28, in which hydrogen atom is contained in an amount of 1-40 atomic percent.

30. A photoconductive member according to claim 20, in which a barrier layer is constructed with an amorphous material in which silicon atom is a matrix and halogen atom is a constituent atom.

31. A photoconductive member according to claim 30, in which the halogen atom is contained in an amount of 1-40 atomic percent.

32. A photoconductive member according to claim 20, in which a barrier layer is constructed with an amorphous material in which silicon is a matrix, and halogen and hydrogen atoms are constitutent atoms.

33. A photoconductive member according to claim 32, in which halogen and hydrogen atoms are contrained in a total amount of 1-40 atomic percent and the hydrogen content is not more than twice the halogen content.

34. A photoconductive member according to claim 20, in which a photoconductive layer has at least one semiconductive characteristic selected from the group consisting of n-type, i-type and p-type.

35. A photoconductive member according to claim 34, in which a photoconductive layer contains an atom in Group III of the Periodic Table in an amount not reaching 50 ppm as an impurity.

36. A photoconductive member according to claim 20, in which a photoconductive layer has a thickness of 1-70 microns.

* * * * *

UNITED STATES PATENT AND TRADEMARK OFFICE

CERTIFICATE OF CORRECTION

PATENT NO. : 4,359,512

DATED : November 16, 1982

INVENTOR(S) : FUKUDA, ET AL.

It is certified that error appears in the above-identified patent and that said Letters Patent is hereby corrected as shown below:

Col. 1, line 58, "extracted" should be --exerted--.
Col. 2, line 50, "rooms" should be --room--.
Col. 3, line 15, "uses" should be --used--.
Col. 4, line 32, "accpetor" snould be --acceptor--.
Col. 4, line 52, "$\frown$" should be -- $\simeq$ --.
Col. 5, line 41, "optimumly" should be --optimally--.
Col. 7, line 60, "turget" should be --target--.
Col. 7, line 64, "a" should be --an--.
Col. 8, line 40, "a Si:X" should be --a-Si:X--.
Col. 9, line 1, "more" first occurrence should be --most--.
Col. 9, line 2, "halogencontent" should be --halogen content--.
Col. 10, line 45, "polyvinyl chloride" second occurrence should be --polyvinylidene chloride--.
Col. 12, line 53, "amount" should be --among--.
Col. 13, line 16, "optimumly" should be --optimally--.
Col. 14, line 17, "stabilized" should be --stabilize--.
Col. 14, line 35, "$\pm$" should be "+".
Col. 15, line 5, "$3\bar{1}0$" should be --320--.
Col. 15, line 25, "312" should be --313--.
Col. 15, lin3 27, "332" should be --322--.
Col. 16, line 29, "$SiF_4$gas" should be --$SiF_4$ gas--.
Col. 16, line 56, "against" should be --again--.
Col. 16, line 67, "has" should be --had--.

UNITED STATES PATENT AND TRADEMARK OFFICE

CERTIFICATE OF CORRECTION

PATENT NO. : 4,359,512

DATED : November 16, 1982

INVENTOR(S) : FUKUDA, ET AL.

It is certified that error appears in the above-identified patent and that said Letters Patent is hereby corrected as shown below:

:ol. 17, line 27, "exposured" should be --exposed--.
:ol. 17, line 42, "evacuate" should be --evacuated--.
:ol. 18, line 49, "outflowvalves" should be --outflow valves--.
:ol. 19, line 36, "discontinued" should be --discontinue--.
:ol. 19, line 42, "10" should be --1.0--.
:ol. 19, line 46, "turn" should be --turned--.
:ol. 21, line 64, "substate" should be --substrate--.
:ol. 22, line 11, "theimpurity" should be --the impurity--.
:ol. 22, line 14, "pootoconductive" should be --photoconductive--.
:ol. 22, line 31, "claim 26" should be --claim 25--.
:ol. 22, lines 53, 54, "contiained" should be --contained.

Signed and Sealed this

*Twelfth* Day of *July 1983*

[SEAL]

*Attest:*

GERALD J. MOSSINGHOFF

*Attesting Officer*

*Commissioner of Patents and Trademarks*